United States Patent [19]

Heilman

[11] Patent Number: 5,016,769

[45] Date of Patent: May 21, 1991

[54] CLOSURE WITH HIGH ENERGY BUTTON

[75] Inventor: Robert J. Heilman, Orland Park, Ill.

[73] Assignee: Continental White Cap, Inc., Norwalk, Conn.

[21] Appl. No.: 550,044

[22] Filed: Jul. 9, 1990

[51] Int. Cl.[5] ..... B65D 51/14

[52] U.S. Cl. ..... 215/230; 215/271; 413/8

[58] Field of Search ..... 215/230, 262, 270, 271; 413/8, 56; 72/348, 379.4

[56] References Cited

U.S. PATENT DOCUMENTS

| | | | |
|---|---|---|---|
| 3,062,396 | 11/1962 | Foss et al. | 215/271 |
| 3,160,302 | 12/1964 | Chaplin | 215/271 |
| 3,460,701 | 8/1969 | Powalowski et al. | 215/341 X |
| 4,121,729 | 10/1978 | Husum | 215/342 X |
| 4,177,746 | 12/1979 | Lee, Jr. et al. | 413/8 |
| 4,341,321 | 7/1982 | Gombas | 220/606 |
| 4,458,469 | 7/1984 | Dunn | 413/8 X |
| 4,533,059 | 8/1985 | Kapolas et al. | 215/262 X |
| 4,616,761 | 10/1986 | Nolan | 215/271 |
| 4,721,219 | 1/1988 | Dullabaun et al. | 215/230 X |
| 4,852,753 | 8/1989 | Ochs | 215/271 |

*Primary Examiner*—Stephen Marcus
*Assistant Examiner*—Vanessa M. Roberts
*Attorney, Agent, or Firm*—Charles E. Brown; Charles A. Brown

[57] ABSTRACT

This relates to a conventional type of closure having a central button which is normally provided with an "up" convex state and which is movable by a vacuum within an associated container to a "down" concave state. The button, as formed, has a zero or tensile stress state with the stress state changing to a compressive stress state when the button is drawn downwardly by a vacuum within the associated container. In accordance with this invention, the button has been reformed so that it is slightly flattened and this reforming has changed the zero or tensile stress state to a compressive stress state thereby providing the button with more stored energy when it is drawn downwardly by a vacuum within an associated container. This additional stored energy provides for a greater flipping action of the button which can be utilized to operate an irreversible tamper indicating system which may be applied to the button.

10 Claims, 2 Drawing Sheets

CLOSURE WITH HIGH ENERGY BUTTON

This invention relates in general to new and useful improvements in closures having a vacuum actuated button which is movable by a vacuum within an associated container from an "up" convex state to a "down" concave state so as to indicate the existence of a vacuum within the associated container, and more particularly to such a closure wherein the button has been reformed so as to increase the compressive energy within the button and thereby provide a closure with a high energy button.

BACKGROUND OF THE INVENTION

Vacuum indicating buttons on closures are used extensively for the food industry because they are an effective quick-detection means and lets one know some very important conditions about the associated container. For example: Is the container sealed?—is the button in the "down" position; has the container been opened, or tampered? If the button is in its "up" position; has the seal been broken because of other causes, such as: severe handling, slow leakage or cracked glass of the container at the seal area that could result in product spoilage?

It is also very reassuring to hear the button "pop" as the closure is twisted off the container. In addition, the button is an invaluable quality control means at the product filling operation. With automatic type detection equipment, the button lets the packer know, instantly, whether to accept the sealed container (button "down") or reject it (button "up") because a seal was not attained.

SUMMARY OF THE INVENTION

However, because of a number of reported incidents of food and drug package tampering, more is required than merely a closure with a button which has "up" and "down" positions. Consideration has been given to providing the button with systems which not only clearly indicate that the closure has been removed from an associated container, but also wherein the system cannot be readily defeated by again producing a vacuum within the container after the closure has been reapplied.

It, however, has been found that in order to provide an irreversible tamper indicating system for a closure provided with a vacuum actuated button, a greater flipping action of the button is required to operate the tamper indicating system and therefore a closure having a high energy button has become necessary.

In accordance with this invention, a conventional closure with a conventional button is first formed, after which the button is reformed by flattening the button profile slightly to change the state of stress in the button area from a zero or tensile stress state to a state of compressive residual stress.

With the above and other objects in view that will hereinafter appear, the nature of the invention will be more clearly understood by reference to the following detailed description, the appended claims, and the several views illustrated in the accompanying drawings.

Figure 1:
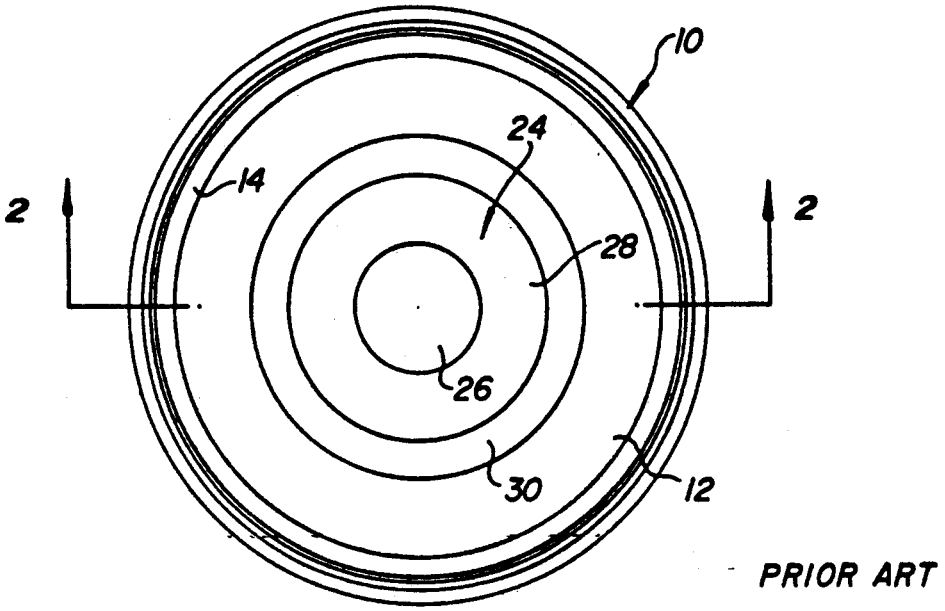
FIG. 1 is a plan view of a prior art closure provided with a vacuum actuated button.
Figure 2:
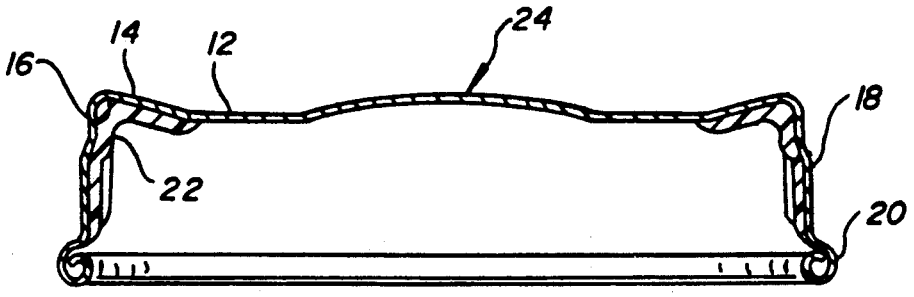
FIG. 2 PRIOR ART
FIG. 2 is a transverse vertical sectional view taken generally along the line 2—2 of FIG. 1 and shows the cross section of the closure with the button in its "up" convex state.
Figure 3:
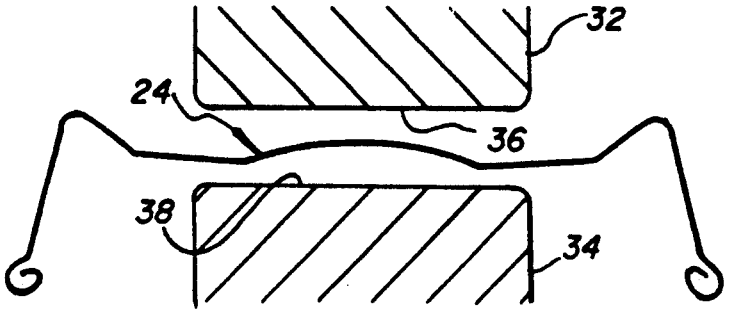
FIG. 3 is a schematic sectional view showing a first method of reforming the button of the closure of FIGS. 1 and 2.

Referring now to the drawings in detail, reference is first made to the prior art closure showing of FIGS. 1 and 2. The closure is generally identified by the numeral 10 and includes an end panel 12 which has an upwardly and outwardly sloping peripheral portion 14 defining a downwardly opening channel. The end panel 12 terminates in a generally cylindrical skirt 18 which, in turn, terminates in an inwardly turned curl 20.

In order that the closure 10 may be applied to a container (not shown) of the type including a neck finish having external threads, the skirt 18 and the channel 16 is lined with a suitable sealing compound 22. When the closure 10 is pressed down on a neck finish of a container, a seal between the closure 10 and the container is formed between that portion of the sealing compound 22 underlying the end panel 12 while an interlock is formed between the threads of the container by that portion of the sealing compound 22 which lines the skirt 18.

A central portion of the end panel 12 is worked to define a normally convex button generally indicated by the numeral 24. The button 24 has a central post portion 26 surrounded by an upwardly sloping annular portion 28 which, in turn, is surrounded by an annular generally flat portion 30.

In operation, prior to the closure 10 being applied to a container, the button 24 is normally in its "up" convex state as best shown in FIG. 2. When the closure 10 is applied to a vacuum packed container, the vacuum within the container will draw the button 24 downwardly into the container to its "down" concave state. The "down" concave state of the button 24 indicates the existence of a vacuum within the container and shows a good seal between the closure 20 and the container.

The button 24, as shown in FIGS. 1 and 2, has a zero or tensile stress state. When the button 24 is drawn down by the vacuum within the container, button 24 requires a state of compressive residual stress. This stored energy causes the button 24 to snap up to its initial position when the vacuum within the container is relieved and most particularly when the closure 10 is removed from the container.

However, the state of compressive residual stress and the button 24 as formed in FIGS. 1 and 2 is not sufficiently high to actuate a desired tamper indicating system which may be applied to the button 24.

Figure 4:
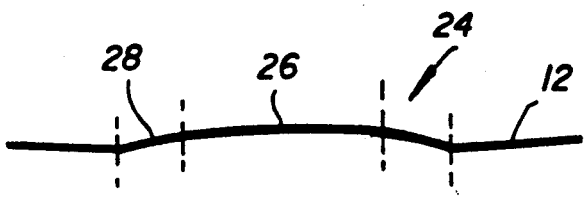
FIG. 4 is an enlarged schematic sectional view taken through the button after it has been slightly flattened in the manner shown in FIG. 3.
Figure 5:
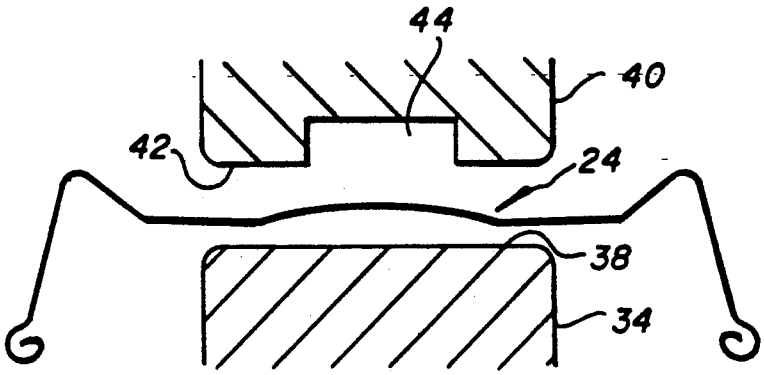
FIG. 5 is another schematic transverse vertical sectional view through a slightly modified apparatus for reforming the button.

In accordance with this invention, it is proposed to slightly flatten the button 24 between an outer anvil 32 and an inner anvil 34 with the anvils 32 and 34 having flat opposed faces 36 and 38, respectively. When the button 24 is flattened between the anvils 32, 34, the button 24 is partially deformed and compressively stressed, particularly in the central portion thereof as shown in FIG. 4.

Figure 6:
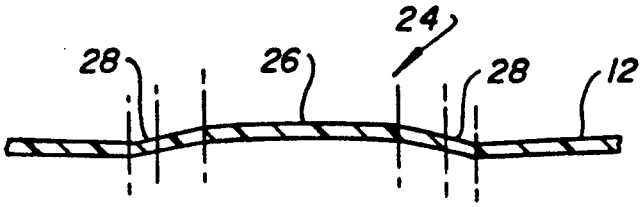
FIG. 6 is an enlarged fragmentary vertical sectional view showing the cross section of the slightly flattened reformed button.

The button 24 may also be slightly flattened by a modified anvil combination including an upper anvil 40 in combination with the lower anvil 34. The upper anvil 40 has a flat face 42 opposing the flat face 38 of the lower anvil 34. However, the face 42 has a central circular portion thereof recessed as at 44. Therefore, the anvil 40 engages only the outer part of the button 24 with the button 24 being slightly deformed as schematically shown in FIG. 6. It will be seen from a comparison of FIGS. 4 and 6 that the flattening of the button 24 utilizing the anvils 40 and 34 will result in a flattening or deformation of primarily the outer part of the button 24.

Figure 7:
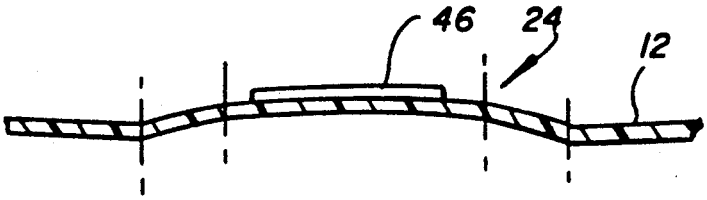
FIG. 7 is an enlarged fragmentary vertical sectional view similar to FIG. 4 but wherein the button has been provided with a tamper indicating system which is activated when the button moves from its "down" state to its "up" state.

It is to be understood that the modified button configuration are to be provided with a tamper indicating system 46 as schematically shown in FIG. 7. The tamper indicating system 46 may vary greatly in type of operation and in of itself does not form a specific part of this invention. Further, while the tamper indicating system 46 has been illustrated in conjunction with the button 24 as modified in FIG. 4, it is to be understood that it may equally as well be applied to the modified button 24 of FIG. 6.

Most particularly, it is to be understood that the greater stored energy produced in the button 24 when moved to its "down" concave position by the vacuum within an associated container provides the button 24 with greater stored energy which will produce a greater flipping action than that produced by the originally formed button 24 of FIGS. 1 and 2. This greater flipping action will be sufficient to actuate the tamper indicating system 46 which is irreversible.

Although only two preferred reformed button arrangements and the manner of effecting such reformation have been specifically illustrated and described herein, it is to be understood that minor variations may be made in the reformed buttons and the method of reforming the same without departing from the spirit and scope of the invention as defined by the appended claims.

I claim:

1. A closure for a container, said closure including an end panel having a button which initially has an "up" position and is drawn to a "down" position by a vacuum generated in an associated container, said button when in said "down" position having stored energy operable to flip said button upwardly when said vacuum is released, said closure being improved by having said button mechanically reformed to a state of compressive residual stress.

2. A closure according to claim 1 wherein said mechanical reforming is in the form of flattening said button.

3. A closure according to claim 1 wherein said button is initially of a convex shape, and said mechanical reforming is in the form of flattening said button.

4. A closure according to claim 1 wherein said button is circular in outline, and said flattening is the greatest in a central portion of said button.

5. A closure according to claim 1 wherein said button is circular in outline, and said flattening is in an annular outer part of said button.

6. A method of forming a closure having a high energy button, said method comprising the steps of forming a closure of the type including an end panel having formed therein a button having a convex upwardly directed profile button, and then reforming said button to effect a degree of flattening said button profile and to provide said button with a state of compressive residual stress.

7. A method according to claim 6 wherein said flattening is primarily in a central part of said button.

8. A method according to claim 6 wherein said flattening is primarily in a central part of said button and is effected by two opposed flat anvils.

9. A method according to claim 7 wherein said flattening is primarily in an annular outer part of said button.

10. A method according to claim 6 wherein said flattening is primarily in an annular outer part of said button, and is effected by two opposed flat anvils with an outer one of the anvils having a central recessed area.

* * * * *